US005522553A

United States Patent [19]

LeClair et al.

[11] Patent Number: 5,522,553

[45] Date of Patent: Jun. 4, 1996

[54] METHOD AND APPARATUS FOR PRODUCING LIQUID SUSPENSIONS OF FINELY DIVIDED MATTER

[75] Inventors: Mark L. LeClair, Scarborough; John A. Higgins, Berwick, both of Me.

[73] Assignee: Kady International, Scarborough, Me.

[21] Appl. No.: 314,817

[22] Filed: Sep. 29, 1994

[51] Int. Cl.[6] ..... B02C 18/40

[52] U.S. Cl. ..... 241/21; 241/46.06; 241/46.17; 241/185.6

[58] Field of Search ..... 241/20, 21, 46.06, 241/46.17, 185.6, 258

[56] References Cited

U.S. PATENT DOCUMENTS

| | | | |
|---|---|---|---|
| Re. 26,931 | 7/1970 | Valdespino | 210/195 |
| 668,211 | 2/1901 | Powter . | |
| 2,024,986 | 12/1935 | Durdin, Jr. . | |
| 2,297,009 | 9/1942 | Mead et al. . | |
| 2,479,403 | 8/1949 | Powers . | |
| 2,628,081 | 2/1953 | Laird . | |
| 2,706,621 | 4/1955 | Laird . | |
| 3,271,304 | 9/1966 | Valdespino et al. . | |
| 3,311,239 | 3/1967 | Valdespino . | |
| 3,497,064 | 2/1970 | Valdespino . | |
| 3,599,881 | 8/1971 | Craig et al. | 241/46.06 |
| 3,620,371 | 11/1971 | Valdespino | 210/117 |
| 4,347,004 | 8/1982 | Platts | 366/137 |
| 4,813,617 | 3/1989 | Knox, Jr. et al. | 241/46.06 |
| 4,959,183 | 9/1990 | Jameson | 261/87 |
| 5,016,825 | 5/1991 | Carpenter | 241/46.06 |
| 5,045,202 | 9/1991 | Stearns et al. | 210/628 |
| 5,240,599 | 8/1993 | Kew et al. | 210/173 |
| 5,282,980 | 2/1994 | Kew et al. | 210/787 |
| 5,380,445 | 1/1995 | Rivard et al. | 210/74.8 |

FOREIGN PATENT DOCUMENTS 9315818 8/1993 WIPO .

OTHER PUBLICATIONS

Centrifugal & Axial Flow Pumps, Theory, Design & Application, A. J. Stepanoff, PHD., 1932.

Water & Waste Technology, Mark J. Hammer, 1975.

An Album of Fluid Motion, Milton Van Dyke, 1988.

*Primary Examiner*—John Husar

*Attorney, Agent, or Firm*—Selitto & Associates

[57] ABSTRACT

A device for producing suspensions of finely divided matter includes a dispersion mill of the type with a slotted rotor and stator. The stator has chamfers on the leading edges to permit fluid flow from the rotor into the stator which is longer in duration, of greater volume, and along a path resulting in an impact angle of 90 degrees. The impact angle generates stagnation forces of a magnitude that results in cavitation when the fluid accelerates away from the impact zone. Subsequent discharges of fluid from rotor to stator slot creates increased ambient pressure around the vapor cavity accelerating cavity collapse and generating high pressures through accelerated collapse and through reentrant jet effects. Shock waves are transmitted locally which disintegrate particulates such as cells.

33 Claims, 8 Drawing Sheets

METHOD AND APPARATUS FOR PRODUCING LIQUID SUSPENSIONS OF FINELY DIVIDED MATTER

FIELD OF THE INVENTION

The present invention relates to rotor and stator colloidal dispersion mills and more particularly to a method and apparatus for producing liquid suspensions of finely divided matter, such as in the manufacture of paints, printing inks, lacquers, carbon paper coatings, in the treatment of waste water, and the like.

BACKGROUND OF THE INVENTION

In the past, rotor and stator colloidal dispersion mills have been used for mechanically disintegrating components of, e.g., waste water sludge, paint, ink and the like to produce liquid suspensions with finely divided components. (See, for instance, U.S. Pat. Nos. 2,628,081, 2,706,621 and 5,240,599). In these patents, liquid containing immiscible liquid(s) and/or partially dispersed solid particulate component(s), are propelled by a rotor against the interior surface of a concentric stator ring having a plurality of radial passageways or slots intermittently spaced around its circumference. The slots have a constant, relatively narrow width compared to the circumference of the stator. The rotor is typically propelled at a very high velocity, e.g., usually between 5,000 to 12,000 feet per minute. As a result, the fluid and entrained immiscibles to be processed are subjected to strong centrifugal forces which induce an outward flow through the narrow slots of the stator.

In U.S. Pat. No. 5,240,599, the rotor itself has a peripheral ring with slots passing radially therethrough and fluid flow is primarily attributable to centrifugal force. When the rotor and stator slots come into alignment, the fluid is ejected from the rotor slots into the stator slots. All components carried in the ejected fluid have an initial resultant velocity attributable to the radial and tangential velocity imparted by the rotor. Predominantly tangential motion causes some portion of the immiscibles carried in the flow through the rotor slot to impinge on the interior radial surface of the stator slot emanating from the trailing edge of the slot, fracturing them into smaller sub-parts. This action is applicable to particles or to globules of undissolved fluids which can be broken down by impinging them against the stator slot walls.

Analysis of the flow exiting the rotor slots in the invention described in U.S. Pat. No. 5,240,599 reveals that the flow exits the rotor slot at approximately 1° to 5° above the tangent at the rotor slot tip. At this angle, impingement of the flow against the radial stator slot face occurs only for the instant when the rotor slot begins to discharge into the stator slot. The majority of the flow impacts the inner circumferential face of the stator at an angle of about 1° to 5°. Because the optimum angle of particle impact against the trailing stator slot face is 90°, a 1° to 5° tangential impact angle greatly reduces impingement efficiency. Because of this, mill efficiency is low (i.e., on the order of 3 to 4%) based on the number of passes through the rotor and stator head that most immiscible materials require before reaching their ultimate particle size.

In addition to the fluid discharge angle from the rotor slot, the clearance between the rotor and stator faces has been determined to be an important factor controlling the geometry of the impact dynamics. For example, 0.000097 seconds is required for the rotor slot to traverse the stator slot in a wastewater version of the dispersion mill as described in U.S. Pat. No. 5,240,599 running at an operational speed of 9,000 feet per minute. In that time, the fluid leaving the rotor slot travels 0.0098 inch towards the stator, which is roughly half the distance across the clearance gap of 0.017 inches. As a result, most of the immiscibles do not impact the trailing face of the radial stator slot, but instead impinge on the stator past the trailing edge of the stator slot.

One important application for apparatus to produce suspensions of finely divided matter is in the biological sciences, i.e., for breaking open or lysing cells, e.g., bacterial cells. Workers in the field of cell disruption have shown that pressures on the order of 5,000 to 20,000 psia are necessary to rupture bacterial cell membranes. Typical lysing processes rely on brute-force techniques to generate high pressures. For example, hydraulic cylinders raise the pressure of a flow stream up to the required pressure of 5,000 to 20,000 psia. The liquid is then forced through an orifice, split into two streams which are brought back together, and made to impinge against one another. This technique is far more energy intensive than comparable lysing with a dispersion mill, which produces these high pressures for a brief instant with each impact.

In summary, current rotor and stator designs for dispersing, disintegrating and comminuting immiscibles in a liquid provide less than optimal impingement angles, insufficient time for clearance gap traversal and insufficient pressure for cell lysing.

SUMMARY OF THE INVENTION

The problems and disadvantages associated with the conventional techniques and devices utilized to create suspensions of finely divided matter and to disintegrate entrained particulates, such as cells, are overcome by the present invention which includes a dispersion mill. The mill has an annular rotor with a first series of slots extending therethrough and an annular stator with a second series of slots extending therethrough. The second series of slots has leading and trailing edges on an inner circumferential surface of the stator relative to the direction of rotation of said rotor. The first series of slots and the second series of slots intermittently align to discharge fluid from the rotor into the stator. The dispersion mill has a chamfer on a plurality of the leading edges of the stator slots for increasing the dispersion efficiency of the mill.

BRIEF DESCRIPTION OF THE DRAWINGS

For a more complete understanding of the present invention, reference may be had to the following detailed description considered in conjunction with the accompanying drawings, in which.

DETAILED DESCRIPTION OF THE EXEMPLARY EMBODIMENTS

Figure 1:
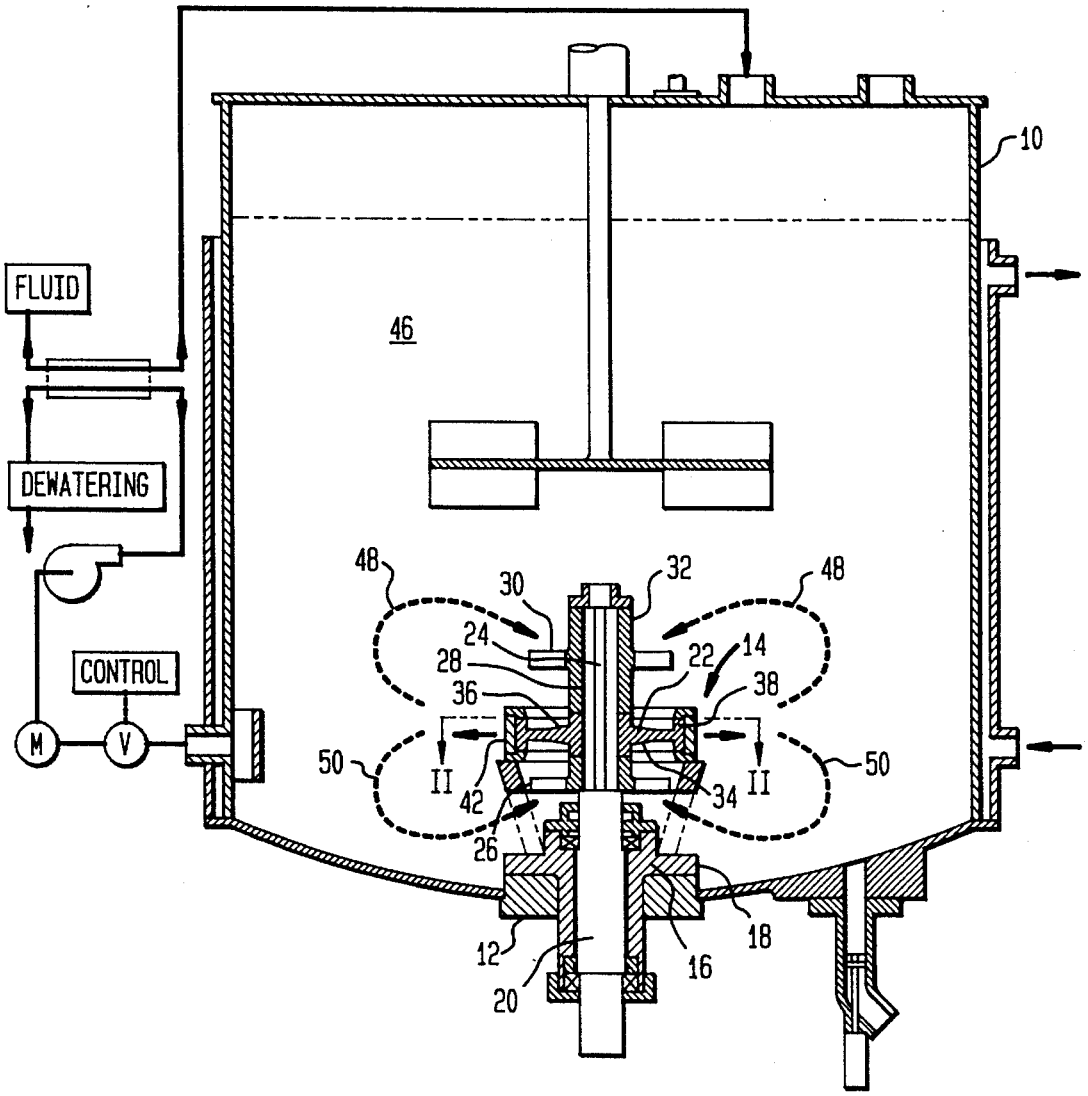
FIG. 1 is a partially schematic, cross-sectional view of an apparatus embodying features of the present invention.

FIG. 1 shows an upstanding cylindrical tank 10 with a circular base plate 12 for mounting a rotor-stator assembly designated generally by numeral 14.

The rotor-stator assembly 14 comprises a generally tubular housing 16 having a flange 18 bolted to base plate 12, such that the assembly 14 can be manufactured as a unit for subsequent installation within a particular tank 10. A vertically oriented shaft 20 extends through housing 16 with a lower end portion of the shaft 20 exposed for connection to a drive motor or pulley, not shown.

A rotor 22 of the type shown, would, in practice, be driven at a speed ranging from about five thousand to about eleven thousand feet per minute. Rotor speeds above eleven thousand feet per minute, are generally considered impractical, because of flow cavitation effects and power efficiency considerations.

Shaft 20 has an axial keyway 24 for removably affixing a stack of annular components to the shaft 20. These components include a lower axial flow propeller 26, the discharge rotor 22, a spacer 28, an upper axial flow propeller 30, and a second spacer 32.

The bladings for propellers 26 and 30, are configured such that the upper propeller 30 produces a downflow stream into rotor 22, whereas the lower propeller 26 produces an upflowing stream into the rotor 22. Rotor 22 has an imperforate web wall 34 extending radially outwardly from a hub 36 in a plane normal to the rotor 22 rotational axis, and an axially thickened peripheral rim wall 38 at the outer edge of web wall 34.

Figure 2:
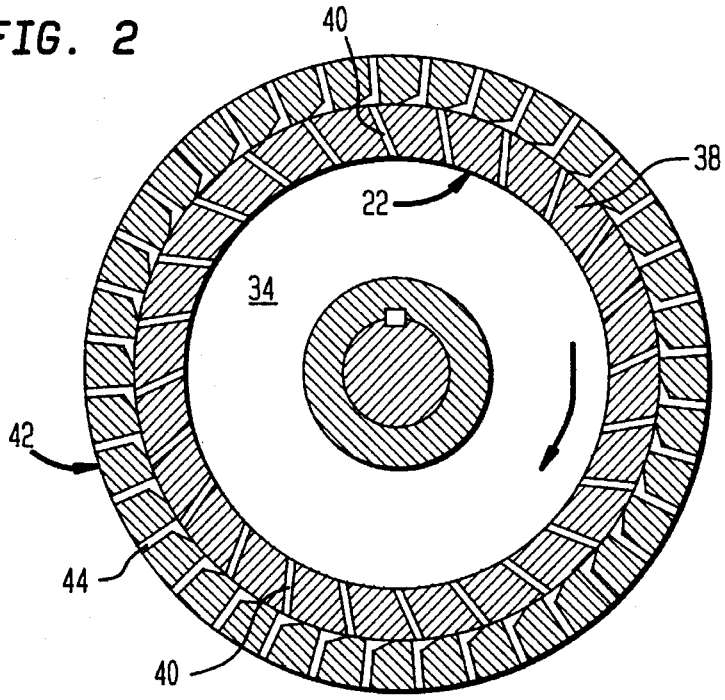
FIG. 2 is an enlarged, cross-sectional view of the rotor and stator of the apparatus shown in FIG. 1 taken along section line II—II.

FIG. 2 shows the rotor 22 rim wall 38 with a number of slot-like passages 40 hereinafter referred to as "slots", extending therethrough at evenly spaced points around the rim wall 38 periphery. There are two sets of slots 40, namely an upper set located above the plane of web wall 34 and a lower set located below the plane of web wall 34. Only the upper set of slots 40 are visible in this view. Rotor 22 is rotatably positioned within a stationary cylindrical stator 42 that has slot-like passages 44 evenly spaced therearound. The configuration of the passages 44 is not simply a straight passage with parallel walls as in prior dispersion mills. Instead, the leading edge of the passages 44 are chamfered, as shall be described and illustrated more clearly below in reference to enlarged drawings of same. This new stator slot configuration constitutes an important aspect of the present invention.

Further referring to FIG. 2, an inner cylindrical side surface of the stator 42 is in close proximity to an outer cylindrical side surface of the rotor 22 with the stator slots 44 intermittently aligning with the rotor slots 40 as the rotor 22 rotates on its central axis. One can further observe that inlet ends of the rotor slots 40 lead the outlet ends in the direction of rotation. To a lesser extent, the stator 42 passages 44 exhibit this same condition, which can also be expressed as an angular displacement away from the radial position, i.e., parallel to a radius extending from the axis of rotation/symmetry. As depicted, with the rotation in the clockwise direction, the slots 40 and passages 44 are rotated counterclockwise from a radial position. The purpose and angular range of these offsets shall be set forth below.

Figure 3:
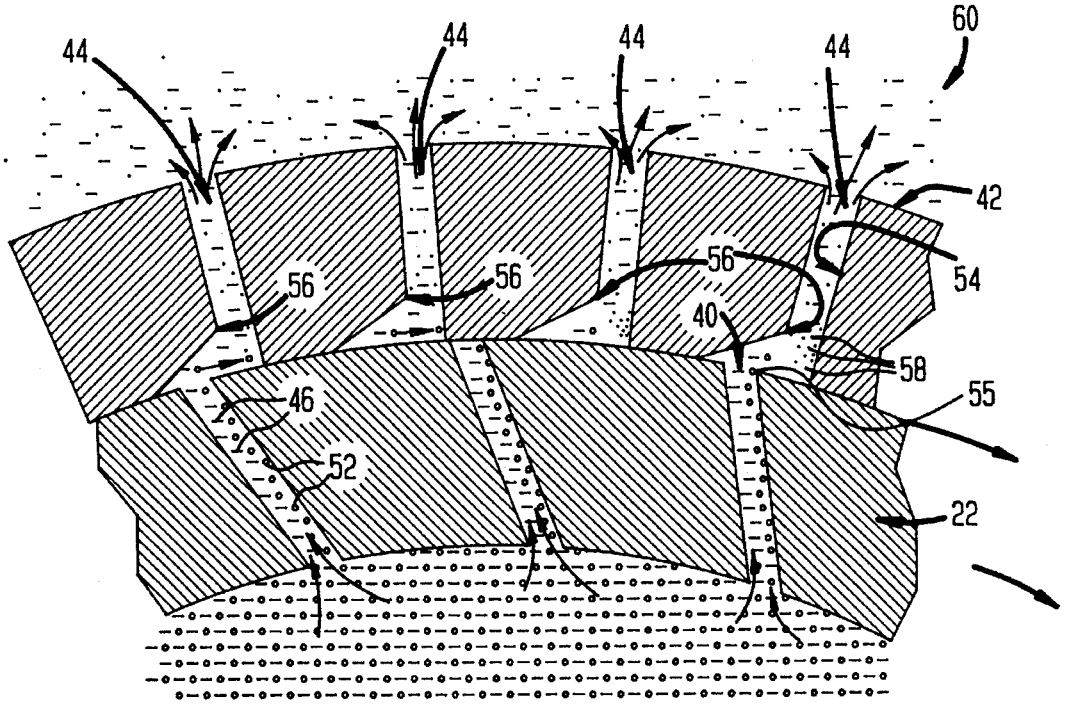
FIG. 3 is a partially schematic, enlarged, fragmentary view of the rotor and stator shown in FIG. 2 showing fluid and particle flow therethrough.

FIG. 3 shows fluid 46 entering and being discharged from the rotor slots 40 into the intermittently aligned stator slots 44. The fluid 46 then discharges from the stator slots 44 into space surrounding the stator, i.e., back into the tank 10. The general fluid flow pattern generated by the rotor and stator 22, 42 within the tank 10 is shown in FIG. 1. Namely, there is an upper toroidal flow path 48 generated by an upper set of rotor slots 40, and a lower toroidal flow path 50 generated by a lower set of rotor slots 40. The axial flow impellers, i.e., propellers 26 and 30, reinforce and maintain the respective flow paths, whereby the fluid 46 is continuously recirculated from the annular zone surrounding stator 42 back into rotor 22. The toroidal flow paths induce fluid 46 bordering the respective paths to be drawn into the rotor 22, such that essentially all of the fluid 46 in the tank 10 is passed through the rotor and stator assembly 14 over a period of time.

Referring back to FIG. 3, given a rotor turning clockwise at a rate of e.g., nine thousand feet per minute, fluid 46 with entrained immiscibles, e.g., solid particles 52, is ejected from the rotor slots 40 principally by centrifugal force. The fluid 46 and entrained immiscibles 52 have both a radial velocity component and a tangential velocity component upon exiting the rotor slot 40, such that the predominantly tangential component causes the ejecta to strike a wall 54 of stator slot 44, at a calculable angle, e.g., 4° above a line tangent to an outer circumference of the rotor 22 at a leading edge 55 of the rotor slot 40. The stator slot 44 is chamfered (i.e. beveled) on a leading edge 56. The effect of relieving the leading edge 56 of the stator slot 44, as shown, is to allow fluid flow from the rotor slot 40 to start sooner, to enter the stator slot 44 earlier, and at a favorable angle. Because the flow starts sooner, it persists for a longer duration, thus increasing the volume of fluid 46 flowing into the stator 42 and the number of immiscibles 52 striking the stator slot radial face 54 and being broken down. It should also be appreciated that starting fluid flow earlier gives the fluid 46 a longer time to traverse the clearance gap between the rotor 22 and stator 42.

The particular angular orientation of the chamfer is selected based upon fluid viscosity, rotor speed and slot orientation to maximally direct fluid flow towards the opposing radial face 54 of the stator slot 44 and to do so in a manner that results in fluid 46 and immiscibles 52 striking the radial face 54 of stator slot 44 at a 90° angle, causing maximum stagnation and resultant disintegration. One can appreciate that the angular orientation of the leading edge 56 of the stator slot 44 also determines the angle of impingement of the fluid 46. The initial impact upon the opposing radial face 54, creates the predominating fragmentation event. Besides fragmentation through impingement, immiscibles 52 are also subjected to shearing forces as edges of the stator slots 44 and rotor slots 40 pass each other in close proximity and at high speed, as well as due to pressures attributable to cavitation.

Figure 4:
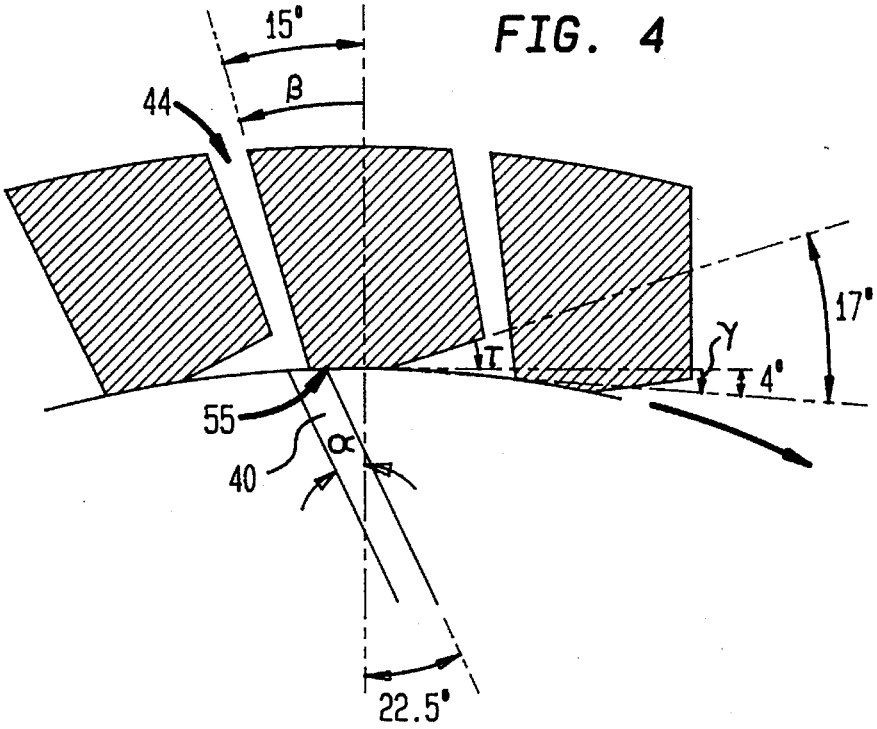
FIG. 4 is an enlarged, fragmentary view of the rotor and stator of FIG. 2 showing exemplary relative orientation for rotor and stator slot faces.

FIG. 4 shows exemplary angular orientations of the various slot surfaces to promote optimal fragmentation of immiscibles. The angular displacement $\alpha$ of the rotor slot 40 illustrated is approximately 22.5° relative to a radial line passing; through a center of the rotor 22. The displacement is opposite to a direction of rotor rotation, which in this instance is clockwise, therefore $\alpha$ is in the counterclockwise direction.

For optimal efficiency, the angle $\beta$ of the stator slot 44 should be approximately about 0° to about 15° relative to a radial line passing through a center of the stator 42. These values for the angle of the stator slot 44 are selected to provide a 90° impact angle for the ejecta and are due to the resultant velocity of the ejecta leaving the rotor slot 40. Ejecta with tangential velocities of less than 9,000 feet per minute require $\beta$ angles between about 7° and about 15° whereas tangential velocities exceeding 9,000 feet per minute require angles between about 0° and about 7°. Ejecta containing heavier "inertial" particles which slice through the fluid require a greater $\beta$ angle than ejecta having lighter particles which intimately follow the fluid flow pattern.

The direction of the resultant velocity of fluid flow is in the range of from about 1° to about 5° at angle $\gamma$ above the tangent at the leading edge 55 of the rotor slot 40. The optimal angle $\tau$ created by the chamfered portion of the stator slot 44 is approximately in the range of from about 14° to about 18°. The flow leaving the rotor slot behaves as a turbulent jet, which always diverges at a 13° half angle. The value for the angle created by the chamfer is calculated to be the sum of the 13° half angle created from the flow leaving the rotor slot 40 and the angle $\gamma$. An angle $\tau$ in the aforesaid range is optimum since a larger angle would induce flow separations at the chamfer and a lesser angle would not be as efficient for the reasons outlined above pertaining to resultant velocity and impact angle.

An opening rate of the chamfer is designed to match the resultant fluid velocity such that ejected fluid travels in parallel to the chamfered face 56. The gap between the rotor 22 and stator 42 should be minimized.

Figure 5:
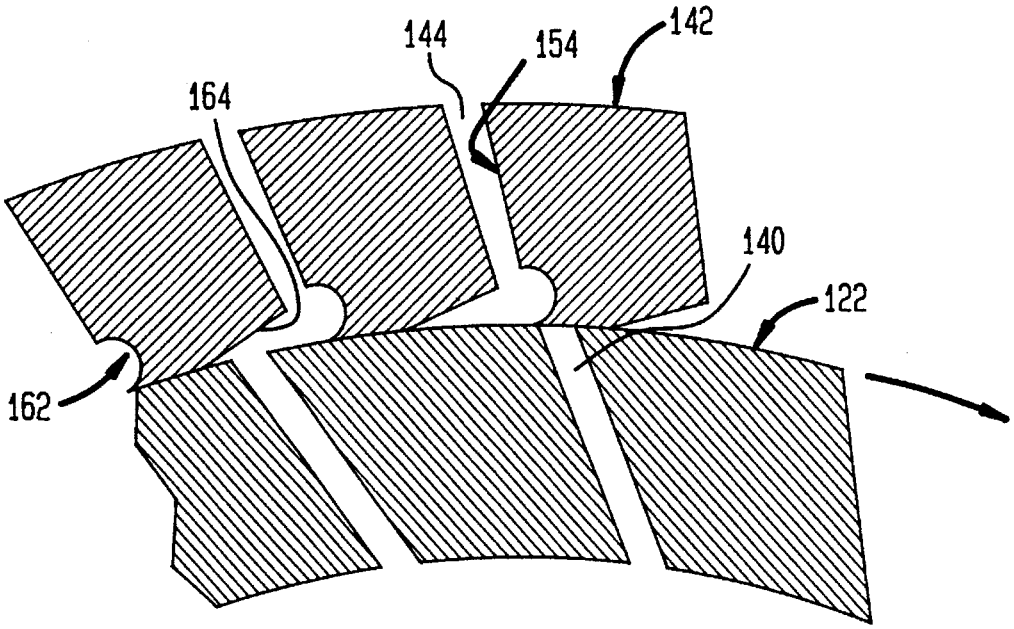
FIG. 5 is an enlarged, fragmentary view of the rotor and stator of FIG. 2 but with an alternative stator slot ,configuration.
Figure 6:
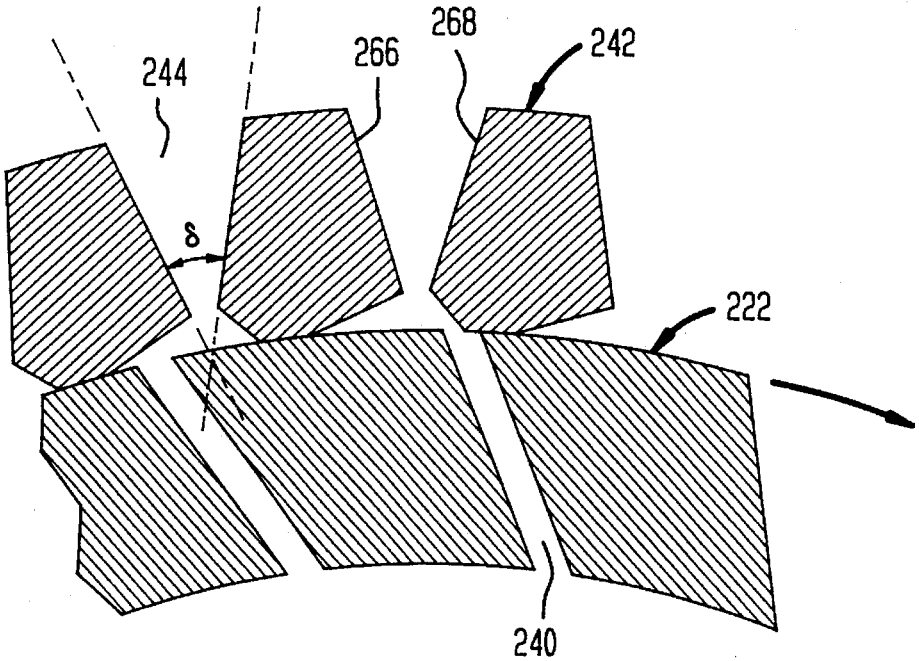
FIG. 6 is a view similar to FIG. 5, but illustrating a second alternate slot arrangement.
Figure 7:
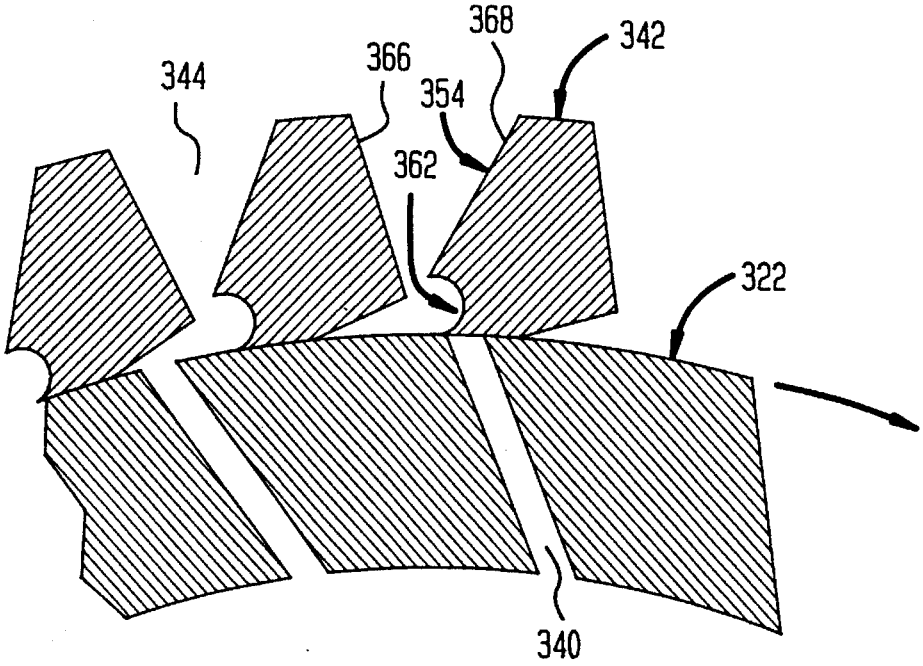
FIG. 7 is a view similar to FIG. 5, but illustrating a third alternate slot arrangement.

Three other enlarged fragmentary views of the rotor and stator 22, 42 but with an alternate stator slot 44 configuration are illustrated in FIGS. 5, 6 and 7. Elements illustrated in FIGS. 5, 6 and 7 which correspond to the elements described above with respect to FIGS. 1–4 have been designated by corresponding reference numerals increased by 100, 200 and 300, respectively. The embodiments of FIGS. 5, 6 and 7 operate in the same manner as the embodiment of FIGS. 1–4, unless it is otherwise stated.

In FIG. 5, the stator slot wall 154 opposite to ejecta flow has a semicircular groove 162 upon which fluid and immiscibles may impact. Given that the ejected stream will be in the form of a diverging cone and will include a continuum of trajectories for its component molecules and entrained immiscibles, the semicircular groove 162 is designed to induce simultaneous impact against the stator 142 for any given cross-sectional sample from the fluid jet or stream. Further, the groove 162 serves to focus the ejecta stream into convergence thereby increasing the likelihood of interparticle collisions. The groove 162 also causes a greater stagnation effect on the ejected stream, presenting a 90° impact angle across the entire stream. A greater change in velocity is also produced by the groove 162, thereby increasing the momentum transfer to the entrained immiscibles. The radius of curvature of the groove 162 is engineered to each situation, depending upon the size of the fluid slug, fluid velocity and hence pressure created, down stream slot geometry and fluid viscosity.

In FIG. 6, the stator slot 244 has a chamfered leading edge as well as slot sides 266, 268 that diverge at the fluid discharge end to form a diffuser. Due to the venturi principle, the nozzle shape reduces fluid friction and drag, thereby decreasing power input requirements. The divergence angle $\delta$ should be less than 15° to avoid separation or vortex flow.

In FIG. 7, the features illustrated in FIGS. 4, 5 and 6 are combined.

Figure 8A:
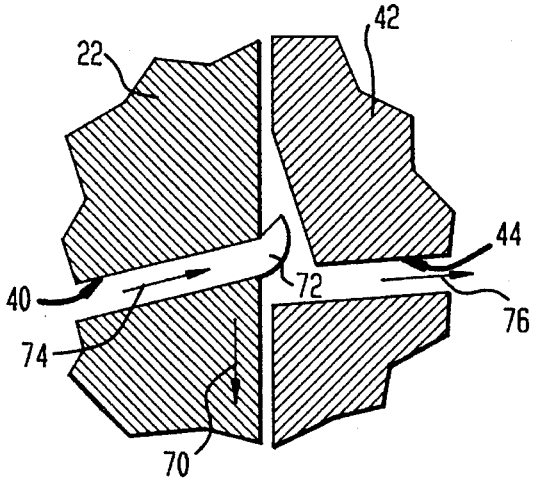
FIGS. 8*a* through 8*f* are sequential, enlarged, diagrammatic views of the hydrodynamic events occurring at a particular interior stator port.

FIGS. 8*a* through 8*f* illustrate certain hydrodynamic events which contribute to the efficacy of the present invention, in particular, its ability to disintegrate entrained particles and matter. In FIG. 8*a*, a rotor slot 40 is depicted approaching alignment with a mating stator slot 44. The rotor 22 is travelling at a high rate of speed, e.g., 9,000 ft./min. in the direction of rotation indicated by the arrow 70. Since these drawings are enlarged, the curvature of the rotor 22 and stator 42 is not discernable. A fluid is present within the rotor and stator slots 40 and 44 respectively, but for the purpose of illustration is not indicated by cross hatching convention. Since the rotor 22 is rotating at a high rate, the fluid within the rotor slot 40 is being accelerated and, as a result, a pressure differential exists between the fluid/particles in the rotor slot 40 and the fluid in the stator slot 44 and the clearance space between rotor 22 and stator 42. This results in a flow of fluid out of the rotor slot 40 and into the stator slot 44.

In FIG. 8*a*, the movement of the fluid from the rotor slot 40 is illustrated by the tapered form 72 which is really an outline of fluid and particulates released from the rotor slot 40 and travelling at a particular velocity relative to the surrounding fluid already in the stator slot 44. An overall flow of fluid through the rotor 22 and the stator 42 is shown by arrows 74 and 76, respectively.

Figure 8B:
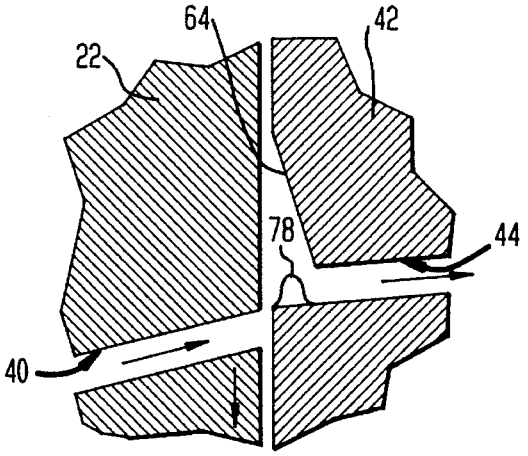

In FIG. 8*b*, the rotor 22 has advanced several degrees and the rotor slot 40 opening has passed the stator slot 44 opening. A discrete portion of fluid or "slug" 78 has been issued from the rotor slot 40 and, due to velocity of the slug 78 and clearance provided by the stator chamfer 64, has impacted and deformed on the stator slot wall 54 emanating from the stator slot trailing edge. Given normal operating conditions, i.e. a rotor tip speed of 9,000 ft./min., this creates a stagnation pressure of about 180 psia in the localized area of the decelerated and compressed slug 78.

Figure 8C:
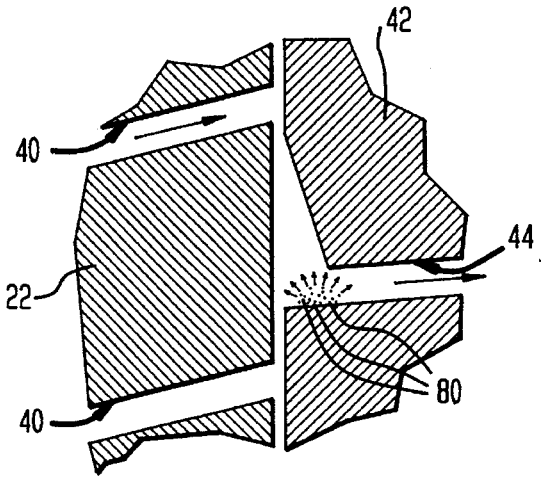
Figure 8D:
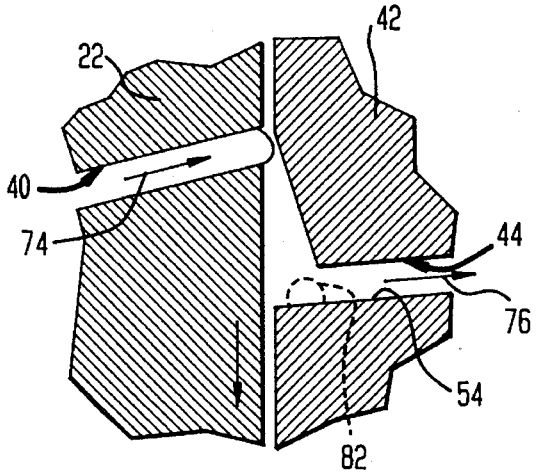

This localized high pressure region causes an outward rebounding acceleration of slug fragments 80 driven by an approximate 12 atmosphere pressure gradient as shown in FIG. 8*c*. The outward acceleration results in the formation of a vapor cavity 82 as shown in FIG. 8*d*. At all times, the region of pressure activity is moving in the general flow path indicated by arrows 74 and 76. The vapor cavity 82 occurs next to a wall surface, i.e., the stator slot wall 54. As a result, the collapse is asymmetric in accordance with known principles. This gives rise to a reentrant jet 84 illustrated in FIG. 8*e*. The jet 84 concentrates the energy of collapse into a small area generating thousands of psia. The high pressures generated by the reentrant jet 84 radiate outward into the surrounding fluid as a wave, exposing entrained particulates, e.g., bacteria, to a dramatic pressure differential which can rupture cells to release the contents.

Figure 8E:
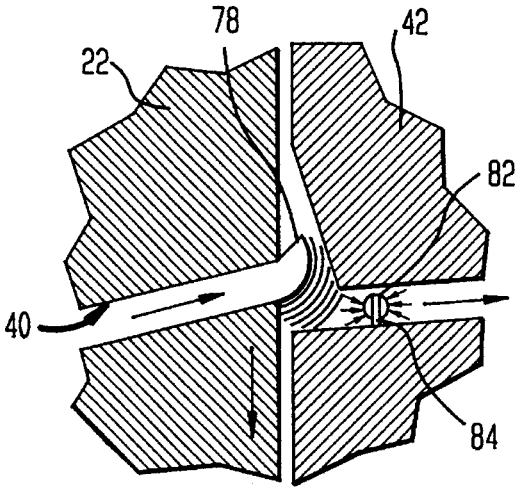

In addition to collapse under atmospheric pressure, the vacuum cavity 82 is also subjected to a heightened ambient pressure due to a subsequent slug 78 which is accelerated toward the cavity 82 as shown in FIG. 8*e*. The accelerated slug 78 generates local pressure waves such that the vapor cavity 82 is collapsed under a pressure of about 12 atm. This condition results in a vacuum cavity collapse which is 10 times faster than the slug 78 velocity.

Figure 8F:
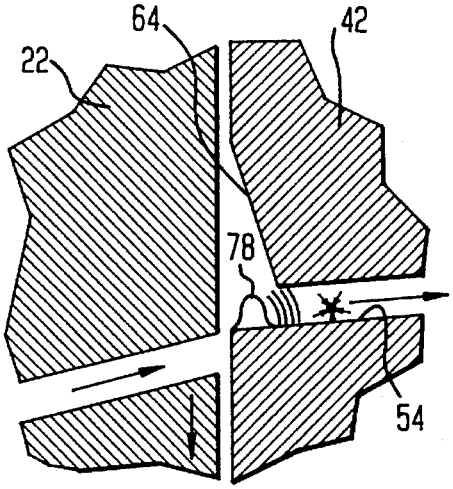

FIG. 8*f* shows the collision of the subsequent slug 78 into the stator slot wall 54 which begins the cycle again. It is the complete collapse of the vapor cavity 82 under the high pressures generated by the fluid ejected from the rotor 22 that results in extremely high pressures in a range of about 30,000 psia. Pressures in this range are effective at lysing even resilient cell membrane material. Thus, the chamfer 64 on the stator slot leading edge 56 allows a larger slug to form which is accelerated to impinge at a more optimal angle for increased stagnation. The increased stagnation pressures and the velocity created by the rotor give rise to fluid acceleration and velocities which induce vapor cavity 82 formation proximate a wall surface. Vapor cavity 82 collapse near the wall 54 results in the formation of a high pressure reentrant jet 84 aimed perpendicular to the wall 54. The collapse of the vapor cavity 82 is accelerated by the next slug which raises ambient pressure. The accelerated vapor cavity 82 collapse and reentrant jet 84 generate high pressures and shock waves which fragment entrained particles. The combination of an accelerated collapse with a collapse next to a wall 54, generates much higher pressures than could be obtained by collapse of a vapor bubble away from the wall 54 and under ordinary atmospheric conditions.

Figure 9:
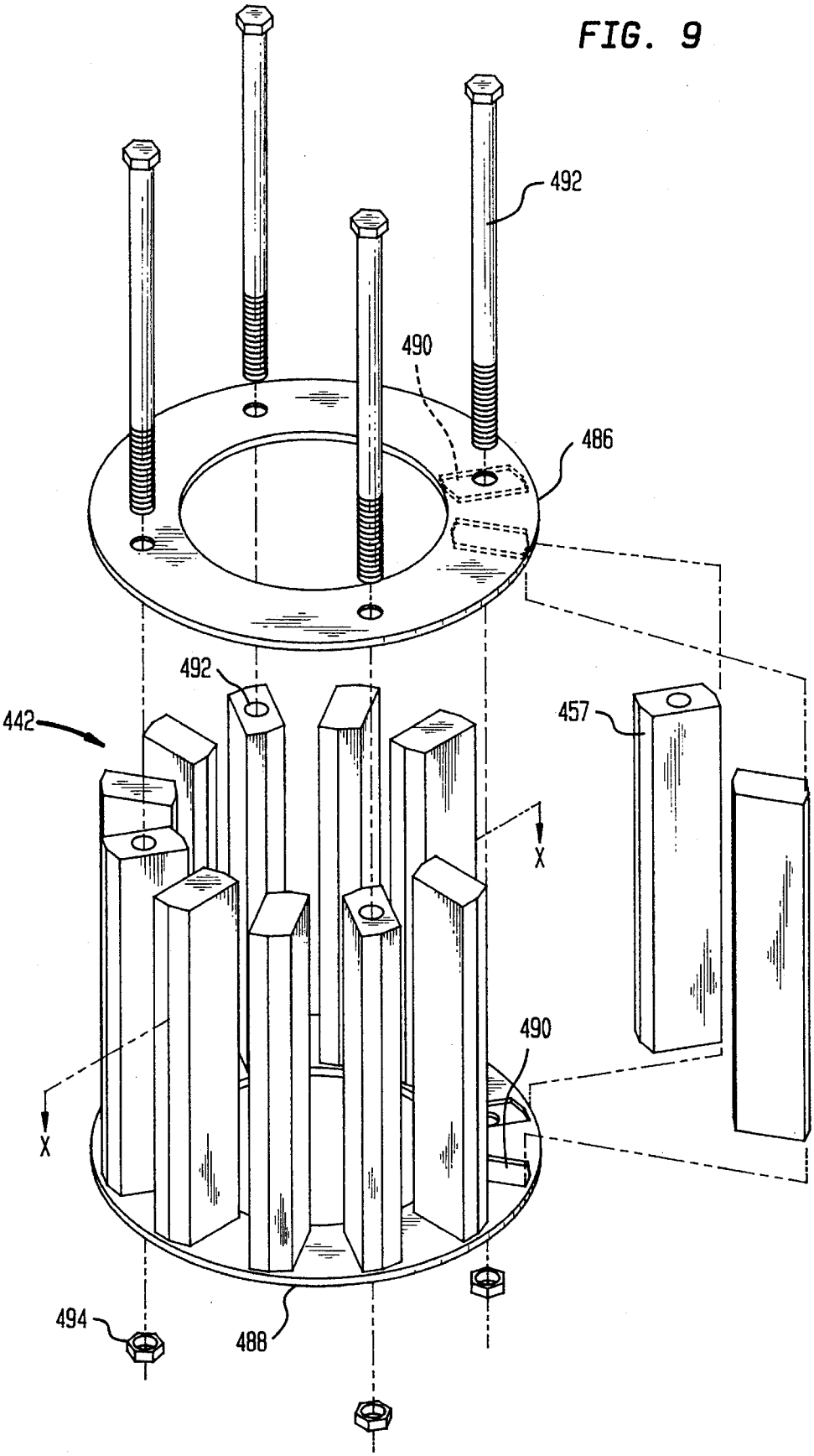
FIG. 9 is a perspective view of another exemplary embodiment of the stator shown in FIG. 2.
Figure 10:
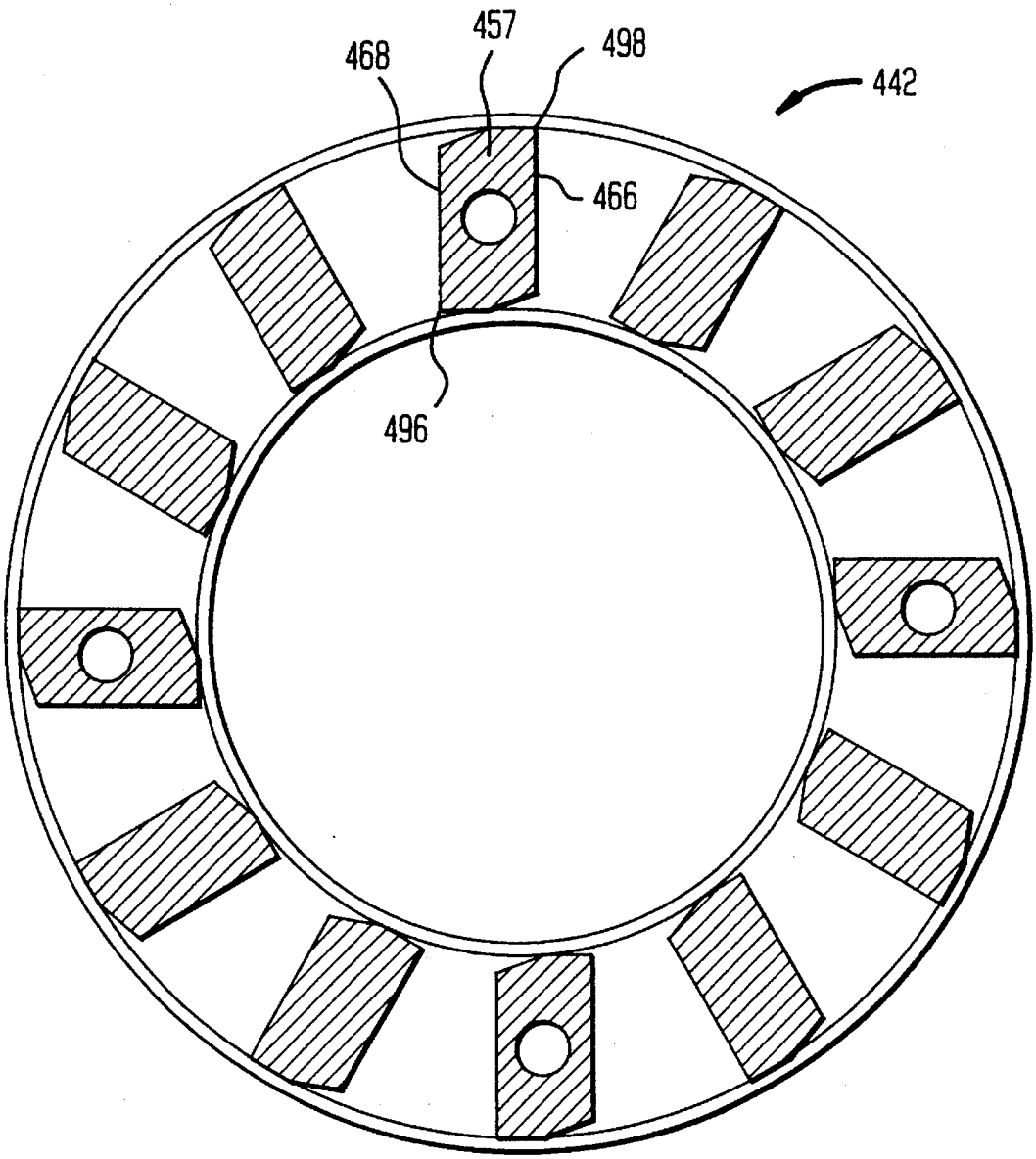
FIG. 10 is a perspective view of the stator shown in FIG. 9 taken along section line X—X.

FIG. 9 shows a stator 442 having a plurality of removable stator blade inserts 457 which are sandwiched between a top retaining ring 486 and a bottom retaining ring 488. The retaining rings 486, 488 are preferably stainless steel and have slots 490 for receiving an associated stator blade insert 457. A plurality of bolts 492 and mating nuts 494 or other suitable fasteners clamp the retaining rings 486, 488 against the stator blade inserts 457 retaining them in position to form a unified stator 442. As shown in FIG. 10, the edges formed by sidewall 466 and inner circumferential surface 496 and by sidewall 468 and outer circumferential surface 498 are chamfered and the stator blade inserts 457 are symmetrical in the cross-sectional view shown. This symmetry permits each stator blade insert 457 to be rotated and used in two positions. More particularly, when a stator blade insert 457 exhibits wear, e.g., at face 468, it can be rotated such that unworn surface 466 is placed in the stream of ejected fluid. To resist erosion due to the impact pressures generated by cavitation, each stator blade insert 457 is preferably fabricated from a cavitation-resistant material such as Stellite 6B. In the event that a particular stator blade insert 457 wears, it may be replaced independently of the other stator blade inserts 457. The drawings herein show relatively few stator blade inserts 457 for ease of illustration. The actual number of stator blade inserts 457 is dependent upon the diameter of the stator 442 and the desired stator slot width.

While the present invention has been described as relating to an apparatus and method for producing suspensions of finely divided components in liquids and for lysing cells, it could also be used to mix miscible components such as soluble solids into solution or to emulsify immiscible liquids. The drawings and description contained herein necessarily depict specific embodiments of the apparatus useful in practice of the present invention. However, it should be appreciated by those skilled in the arts pertaining thereto, that the present invention can be practiced in various forms and configurations. Further, the previous detailed description of the preferred embodiments of the present invention, is presented for purposes of clarity of understanding only, and no unnecessary limitations should be understood or implied therefrom. Finally, all appropriate mechanical and functional equivalents to the above, which may also be obvious to those skilled in the arts pertaining thereto, are considered to be encompassed within the claims of the present invention.

We claim:

1. In a dispersion mill having an annular rotor with a first series of slots extending therethrough and an annular stator with a second series of slots extending therethrough, each of said second series of slots defined by a first slot wall and a second slot wall forming leading and trailing edges, respectively, of each of said slots on an inner circumferential surface of said stator, relative to the direction of rotation of said rotor, said first series of slots and said second series of slots intermittently aligning to discharge fluid from said rotor into said stator, the improvement comprising:

a chamfer on a plurality of said leading edges of said stator slots for increasing the dispersion efficiency of said mill, said chamfer constituting a surface having an orientation differing from a remainder of said first slot wall, said orientation being selected such that at least a portion of an ejected stream of fluid discharged from each of said rotor slots impacts upon an interior surface of a corresponding one of said stator slots at an impact angle of approximately 90°.

2. The improved dispersion mill of claim 1, wherein the angular orientation of said chamfer is approximately in the range of from about 14° to about 18° above the tangent line to said inner circumferential surface of said stator.

3. The improved dispersion mill of claim 2, wherein an ejected stream of fluid discharged from said rotor slot travels substantially parallel to a face of said chamfer.

4. The improved dispersion mill of claim 3, wherein each slot of said second series of slots is positioned at an angle in the range of about 20° to about 15° relative to a radial line passing through the center of said stator and angularly displaced opposite to the direction of rotor rotation.

5. The improved dispersion mill of claim 4, wherein each slot of said first series of slots forms an angle of about 22.5° relative to a radial line passing through the center of said rotor and angularly displaced opposite to the direction of rotor rotation.

6. The improved dispersion mill of claim 5, wherein said impact angle of 90° results in an increased stagnation pressure.

7. The improved dispersion mill of claim 6, wherein said increased stagnation pressure leads to fluid acceleration and velocity sufficient to form a vapor cavity.

8. The improved dispersion mill of claim 7, wherein said vapor cavity is formed and collapses proximate a wall of said stator slots resulting in the formation of a reentrant jet during vapor cavity collapse, said reentrant jet being aimed at said wall of said stator slots.

9. The improved dispersion mill of claim 8, wherein said vapor cavity collapse is accelerated by a heightened ambient pressure increase attributable to the presence of said ejected stream of fluid discharged from said rotor slot.

10. The improved dispersion mill of claim 9, wherein said vapor cavity collapse and impingement of said reentrant jet at said wall of said stator slots generate pressure waves which disintegrate entrained particles in said fluid.

11. The improved dispersion mill of claim 10, wherein pressures exceeding 20,000 psia are generated within said fluid due to said vapor cavity collapse.

12. The improved dispersion mill of claim 1, wherein an interior surface of said stator slots emanating from said trailing edges of said stator slots has a groove therein extending axially along said interior surface proximate said trailing edge for further increasing the dispersion efficiency of said mill.

13. The improved dispersion mill of claim 12, wherein said groove focuses an ejected stream of fluid discharged from said rotor slot into convergence whereby the likelihood of interparticle collisions is increased.

14. The improved dispersion mill of claim 13, wherein the radius of curvature of said groove is approximately equal to a distance from a leading edge to a central point of impact of said ejected stream on said interior surface, said groove increasing the probability that said ejected stream will impact said interior surface at an impact angle of approximately 90°.

15. The improved dispersion mill of claim 1, wherein said chamfer has an angular orientation relative to the tangent line to said inner circumferential surface of said stator approximating the sum of the half angle of divergence of an ejected stream of fluid discharged from said rotor slot and the angle formed by the resultant velocity of said ejected stream and said tangent line.

16. The improved dispersion mill of claim 15, wherein said angle formed by the resultant velocity of said ejected stream and said tangent line is in the range of about 1° to about 5°.

17. The improved dispersion mill of claim 16, wherein said half angle of divergence is approximately 13°.

18. The improved dispersion mill of claim 1, wherein walls defining said stator slots diverge in an outward direction to form a diffuser.

19. The improved dispersion mill of claim 18, wherein said diverging stator slots decrease the resistance to fluid flow through said stator, thereby lowering a power requirement and enhancing vapor cavity formation.

20. The improved dispersion mill of claim 1, wherein said plurality of chambers increase the duration and volume of fluid discharged from said rotor into said stator.

21. The improved dispersion mill of claim 1, wherein said stator includes a plurality of removable stator blades.

22. The improved dispersion mill of claim 21, wherein said stator blades are retained by clamping means for restraining said stator blades in position relative to one another to define said second series of slots.

23. The improved dispersion mill of claim 22, wherein said clamping means includes a pair of opposing concentric rings and fastening means for clamping said stator blades therebetween.

24. The improved dispersion mill of claim 21, wherein said stator blades are symmetrical along at least one axis to permit use of said blades in said stator in at least two alternative positions.

25. The improved dispersion mill of claim 21, wherein said stator blades are formed from a material resistant to the effects of cavitation.

26. The improved dispersion mill of claim 25, wherein said material is Stellite 6B.

27. A method for producing liquid suspensions of finely divided matter using a dispersion mill having an annular rotor adapted to generate a plurality of propelled streams of liquid which are discharged from said rotor into an annular stator having a series of slots extending from an inner circumferential surface of said stator to an outer circumferential surface of said stator, each slot of said series of slots having a leading wall, which terminates in a chamfered edge with a chamfer face extending from said inner circumferential surface of said stator to said leading wall, and a trailing wall, which terminates in a trailing edge proximate to said inner circumferential surface of said stator, said method comprising the steps of discharging at least one of said propelled streams of liquid into a corresponding one of said stator slots along a pathway substantially parallel to said chamfer face of said corresponding one of said stator slots, whereby said at least one of said propelled streams of liquid forms at least one substantially unimpeded stream of liquid entering said corresponding one of said stator slots, and impacting said at least one unimpeded stream of liquid against said trailing wall of said corresponding one of said stator slots, whereby said at least one unimpeded stream of liquid initially contacts said stator at said trailing wall of said corresponding one of said stator slots, said impacting step being capable of inducing cavitation collapse when said rotor is rotated at a speed sufficient to induce cavitation.

28. The method of claim 27, wherein said parallel pathway of said at least one unimpeded stream of liquid results in increased stagnation pressure and the subsequent formation and collapse of a vapor cavity and further comprising the step of disintegrating matter entrained in said liquid.

29. The method of claim 28, wherein said vapor cavity collapse gives rise to a reentrant jet.

30. The method of claim 28, wherein said entrained matter is cellular and said step of disintegrating results in cell lysing.

31. The method of claim 27, wherein said pathway is substantially perpendicular to said trailing wall.

32. A dispersion mill, comprising:

(a) an annular rotor adapted to generate a plurality of propelled streams of liquid therefrom;

(b) an annular stator having a series of slots extending from an inner circumferential surface thereof to an outer circumferential surface, said propelled streams of liquid discharging from said rotor into said stator slots and impacting upon a trailing wall of said stator slots, said annular stator having means for inducing cavitation in said liquid discharged from said rotor into said stator slots, said means for inducing cavitation including a chamfer on a plurality of leading edges of said stator slots, said cavitation aiding in the disintegration of entrained matter.

33. The dispersion mill of claim 32, wherein said entrained matter is cellular.

* * * * *

UNITED STATES PATENT AND TRADEMARK OFFICE

CERTIFICATE OF CORRECTION

PATENT NO. : 5,522,553

DATED : JUNE 4, 1996

INVENTOR(S) : MARK L. LECLAIR, JOHN A. HIGGINS

It is certified that error appears in the above-indentified patent and that said Letters Patent is hereby corrected as shown below:

In The Claims

Column 8, line 28, delete "20" and insert --0--.

Column 9, line 29, delete "chambers" and insert --chamfers--.

Signed and Sealed this

Fifteenth Day of October, 1996

Bruce Lehman

*Attest:*

BRUCE LEHMAN

*Attesting Officer*

*Commissioner of Patents and Trademarks*